United States Patent [19]

Ueda

[11] Patent Number: 4,625,435

[45] Date of Patent: Dec. 2, 1986

[54] SPORTS SHOE

[75] Inventor: Noboru Ueda, Chikushino, Japan

[73] Assignee: Nippon Rubber Co., Ltd., Tokyo, Japan

[21] Appl. No.: 646,120

[22] Filed: Aug. 31, 1984

[30] Foreign Application Priority Data

Sep. 1, 1983 [JP] Japan ..... 58-137005[U]
Mar. 6, 1984 [JP] Japan ..... 59-31317[U]

[51] Int. Cl.[4] ..... A43B 23/08

[52] U.S. Cl. ..... 36/68; 36/69; 36/114

[58] Field of Search ..... 36/68, 69, 114

[56] References Cited

U.S. PATENT DOCUMENTS

| | | | |
|---|---|---|---|
| 208,943 | 10/1878 | Wissen | 36/68 |
| 1,800,720 | 4/1931 | Davis et al. | 36/68 |
| 2,638,689 | 5/1953 | Stritter | 36/68 |
| 2,738,600 | 3/1956 | Schulz | 36/68 |
| 4,255,877 | 3/1981 | Bowerman | 36/69 |
| 4,288,929 | 9/1981 | Norton et al. | 36/69 |
| 4,322,895 | 4/1982 | Hockerson | 36/69 |
| 4,402,146 | 9/1983 | Parracho et al. | 36/69 |
| 4,459,765 | 7/1984 | Power | 36/69 |
| 4,484,397 | 11/1984 | Curley, Jr. | 36/69 |

FOREIGN PATENT DOCUMENTS

| | | | |
|---|---|---|---|
| 323890 | 1/1935 | Italy | 36/68 |

*Primary Examiner*—Werner H. Schroeder
*Assistant Examiner*—Steven N. Meyers
*Attorney, Agent, or Firm*—Birch, Stewart, Kolasch & Birch

[57] ABSTRACT

A sports shoe having a heel counter with a heel reinforcement wall shaped to include an inner surface which is in conformity with an outer surface of a heel portion of an upper of the sports shoe. An attaching portion is formed to project inwards from a lower end portion of the heel reinforcement wall. A flange portion formed to project outwards from the lower end portion of the heel reinforcement wall is provided in such a manner that the inner surface of the heel reinforcement wall is adhered to the outer surface of the heel portion of the upper. The attaching portion thereof is interposed between and adhered to an inwardly bent portion of the upper portion and a shoe sole. The flange portion thereof is adhered to an upper surface of an outer peripheral edge portion of the shoe sole. In this manner, the heel portion is prevented from rolling during running and the heel counter is prevented from peeling off.

6 Claims, 8 Drawing Figures

SPORTS SHOE

BACKGROUND OF THE INVENTION

1. Field of the Invention

This invention relates to a sports shoe for preventing a heel portion thereof from rolling during running and also preventing a heel counter thereof from peeling off.

2. Description of Background Art

As for sports shoes such as running shoes or the like, shoe soles have generally been known, from a viewpoint of shock absorbing during running, wherein the shoe sole thereof is formed of a single layer of resilient foam material, as in the case of a sponge sole, or plural layers of resilient foam materials complying with various functions.

During the gait cycle of a runner wearing shoes of this type, his body weight load applied to the sole of the foot begins with the initial action of contacting a rearward outside portion of the heel portion with the ground. The load position is moved in sequence in conjunction with the subsequent contacting of the heel portion, the plantar arch portion and the ball portion of the fifth toe, and the final action of kicking off the ground with the first toe portion and the second-fifth toe portions. Accordingly, the shoe sole is compressed to be deformed in accordance with the above movement of the body weight loaded thereon, so that the heel portion of the shoe is rolled or laterally inclined during the period of time from the initial ground contacting, through the succeeding contacting, to the kick off action. It is possible that this rolling motion of the heel portion may be a cause of injury to the ankle or the knee joint.

To overcome the above defect, there has been hitherto proposed a sports shoe as disclosed in Japanese Patent Publication No. Sho 57-21321, Japanese unexamined utility model application Publication No. Sho 57-74708 and Japanese unexamined utility model application Publication No. Sho 57-76504. A hard counter is provided with a heel reinforcement wall which is shaped in conformity with an outer surface of a heel portion of an upper. An attaching portion includes an outer periphery portion which is provided with a heel reinforcement wall so as to be integral therewith. The heel reinforcement wall thereof is adhered to the outer surface of the heel portion of the upper and an attaching portion thereof is interposed between and adhered to an inwardly bent portion of the upper and a shoe sole so that the heel portion may be prevented from rolling by the hard counter.

However, since the attaching portion and the heel reinforcement wall of the hard counter of the proposed shoe meet one with another at right angles and since the shoe sole is made of a resilient foam material, the body weight load of a runner wearing the proposed shoe, during running, is applied largely to a boundary line between the attaching portion and the heel reinforcement wall. In this manner, the shoe sole of the resilient foam material is compressed excessively at a portion extending along the foregoing boundary line, and in conjunction therewith the hard counter is brought into a laterally inclined condition. As a result, the hard counter is defective not only in not sufficiently preventing rolling motion of the heel portion of the shoe during running, but also in that the attaching portion of the counter and the shoe sole are liable to be separated one from another along the foregoing boundary line.

SUMMARY AND OBJECTS OF THE PRESENT INVENTION

This invention is to overcome the above defect and to provide a sports shoe for preventing a heel portion thereof from rolling and preventing a heel counter thereof from peeling off. The present invention is characterized in that a heel counter is provided having a heel reinforcement wall with an inner surface which is shaped in conformity with an outer surface of a heel portion of an upper of a sports shoe. An attaching portion is formed to project inwards from a lower end portion of the heel reinforcement wall. A flange portion is formed to project outwards from the lower end portion of the heel reinforcement wall which is provided in such a manner that the inner surface of the heel reinforcement wall is adhered to the outer surface of the heel portion of the upper. The attaching portion is interposed between and adhered to an inwardly bent portion of the upper portion and a shoe sole, and the flange portion is adhered to an upper surface of an outer peripheral edge portion of the shoe sole.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Embodying examples of the present invention will now be explained with reference to the accompanying drawings.

Figure 1:
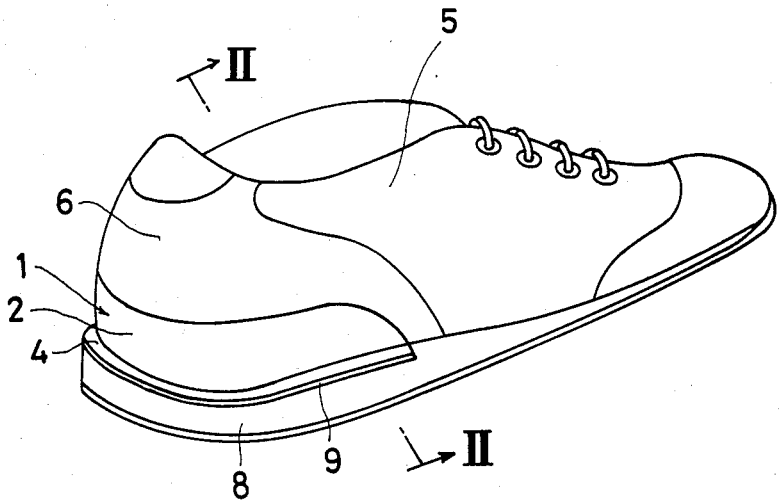
FIG. 1 is a perspective view of one embodying example of the sports shoe according to the present invention.
Figure 2:
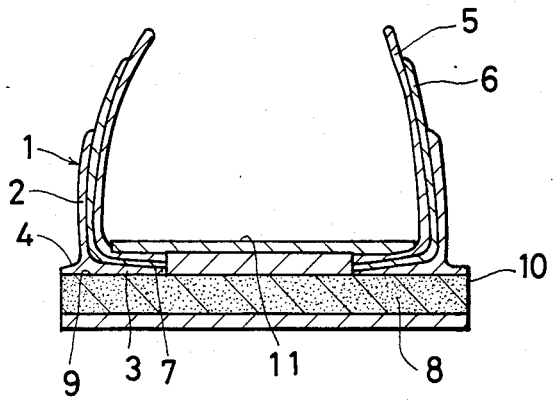
FIG. 2 is a sectional view taken along the line II—II in FIG. 1.
Figure 3:
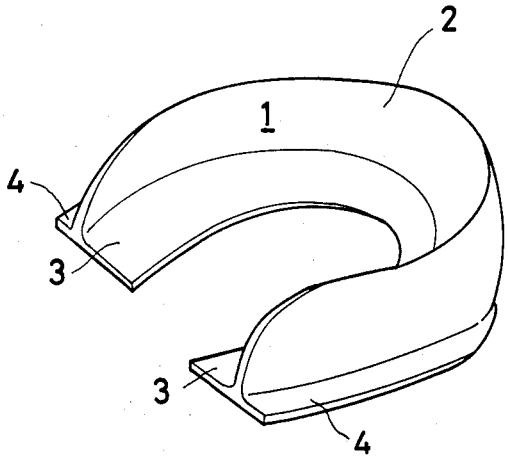
FIG. 3 is a perspective view of a heel counter used therein.

One embodying example of the sports shoe of the present invention is illustrated in FIGS. 1 to 3. The sports shoe is so constructed that an inner surface of a heel reinforcement wall 2 of a heel counter 1 is adhered to an outer surface of a heel portion 6 of an upper 5, and an attaching portion 3 of the heel counter 1 is interposed between and adhered to an inwardly bent portion 7 of the upper 5 and a shoe sole 8. A flange portion 4 of the heel counter 1 is adhered to an upper surface 9 of an outer peripheral edge portion of the shoe sole 8. The heel counter 1 used in this example is made of a semi-hard or hard material such as a rubber material, a synthetic resin material or a mixture material thereof. As shown clearly in FIG. 3, the counter 1 comprises the heel reinforcement wall 2 which is shaped to include an inner surface in conformity with that of the outer surface of the heel portion 6 of the upper 5 of a shoe. The attaching portion 3 is formed to project inwards from a lower end portion of the heel reinforcement wall 2. The flange portion 4 is formed to project outwards from the lower end portion of the heel reinforcement wall 2. The shoe sole 8 shown in the illustrated example is one which is formed of multi-layers comprising an insole made of spongy material and an outsole made of a material different therefrom. However, the shoe sole may be formed of one single layer made of rubber, sponge or the like.

Referring to FIGS. 1–5, a side surface 10 of an outer peripheral side edge portion of the shoe sole 8 is provided together with an insole 11 and a midcore member 12.

Since the heel counter 1 used in the foregoing example is provided with the flange portion 4 projecting outwards from the lower end portion of the heel reinforcement wall 2 thereof, the weight of the load of a runner during running is distributed over the whole of the flange portion 4 through the heel reinforcement wall 2. Accordingly, even if the shoe sole 8 is made of a resilient foam material, there does not occur any partial compression of the shoe sole of the resilient foam material along a boundary line between the attaching portion and the heel reinforcement wall that is the cause for the rolling motion in the case of the conventional counter. Thus, with the heel counter 1 of the present invention, a lateral inclination of the heel reinforcement wall, that is, a rolling motion thereof, can be prevented. At the same time, a force does not occur for separating from each other the attaching portion and the heel reinforcement wall along the boundary line as has occurred in the case of the conventional heel counter.

Figure 5:
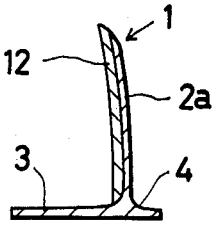
FIG. 5 is a sectional view taken along the line V—V in FIG. 4.
Figure 4:
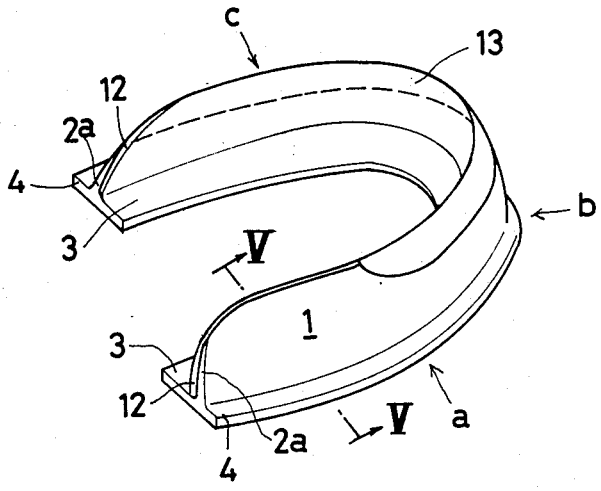
FIG. 4 is a perspective view of a modified example of the heel counter.

FIGS. 4 and 5 show a modified example of the heel counter 1 employed in the sports shoe according to the present invention. In this example, the heel counter 1 is arranged so that the heel reinforcement wall 2 thereof is composed of plural layers of a main reinforcement wall 2*a* and a subsidiary reinforcement wall 12. The reinforcement wall 2 is formed of a multi-layer wall wherein the subsidary reinforcement wall 12 is made of a soft material as compared with the material of the main reinforcement wall 2*a*. The subsidiary reinforcement wall 12 is positioned on the inner surface of the main reinforcement wall 2*a*. Thus, when the foot of a runner is in frictional contact with the heel reinforcement wall 2 during running, due to the fact that the subsidiary reinforcement wall 12 is positioned on the inner side of the main reinforcement wall 2*a*, there is not caused any injury such as a shoe sore of the like during wearing of the sports shoe. This result is to be contrasted with a shoe using a heel counter made of a single hard material alone. The modified example set forth in FIGS. 4 and 5 provides a sports shoe which is extremely comfortable to wear.

As illustrated in FIG. 4, the main reinforcement wall 2*a* and the subsidiary reinforcement wall 12 are substantially equal to one another in height at a medial portion *a* of the heel counter 1 which is to be adhered to the inside of the heel portion 6 of the upper 5. In addition, the subsidiary reinforcement wall 12 is larger in height than the main reinforcement wall 2*a*, at a rear side portion *b* of the heel counter 1 which is to be adhered to the rear side of the heel portion 6 of the upper 5 and at a lateral portion *c* of the heel counter 1 which is to be adhered to the outside of the heel portion 6 of the upper 5. By this arrangement, a heel counter 1 is formed with rigidity maintained as a whole at its inside portion *a*, while an upper portion 13 of the heel counter 1 is formed only of the soft subsidiary reinforcement wall 12 at the rear side portion *b* and at its outside portion *c*. Thus, flexibility is provided at the upper portion 13 due to its softness. The sports shoe according to this arrangement can fit the foot without affecting the wearing feeling and in addition is effective for preventing the heel portion of the shoe from rolling during running.

In addition, in the case wherein a hard material for instance is used for both the main reinforcement wall 2*a* and the subsidiary reinforcement wall 12, the heel counter 1 can have a rigidity as a whole. However, since the upper portion 12 of the heel counter 1 is formed of a thin layer of the subsidiary reinforcement wall 12 alone, there can be obtained at that upper portion 13 a flexibility relatively to the remainder double wall portions. Accordingly, the shoe can fit the foot, without affecting the wearing feeling.

Figure 6:
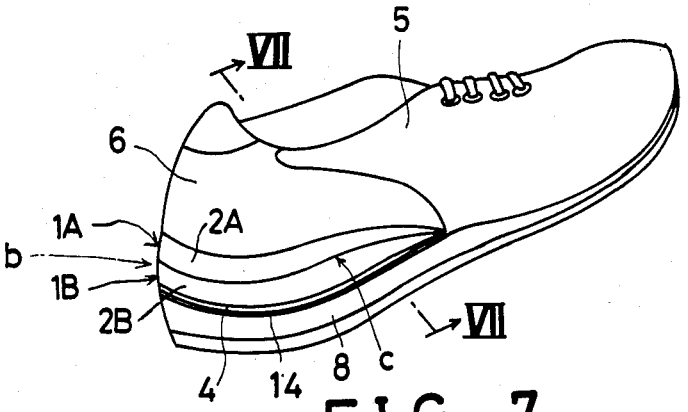
FIG. 6 is a perspective view of another embodying example of the sports shoe according to the present invention.
Figure 7:
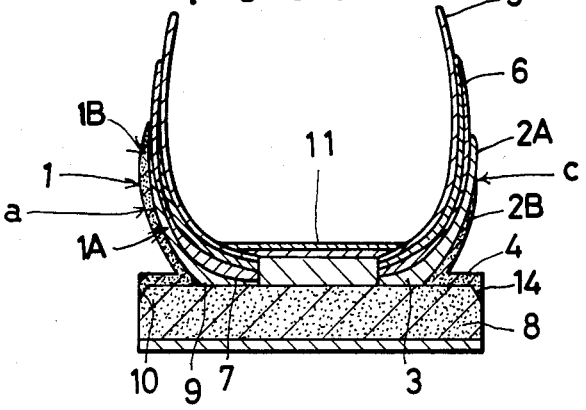
FIG. 7 is a sectional view taken along the line VII—VII in FIG. 6.
Figure 8:
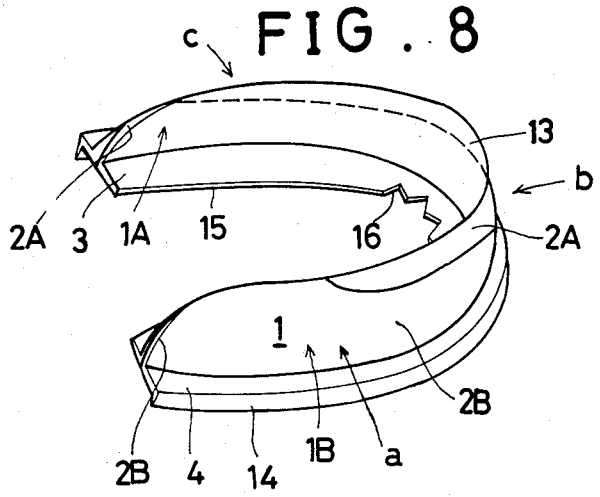
FIG. 8 is a perspective view of a heel counter used therein.

FIGS. 6 to 8 show another embodying example of the sports shoe according to the present invention. In this example, the heel counter 1 thereof comprises an inner half counter 1A and an outer half counter 1B. In more detail, the heel counter 1 comprises the inner half counter 1A having the attaching portion 3 formed to project inwards from a lower end portion of an inner heel reinforcement wall 2A and the outer half counter 1B having the flange portion 4 formed to project outwards from a lower end portion of an outer heel reinforcement wall 2B. The outer surface of the inner heel reinforcement wall 2A and the inner surface of the outer heel reinforcement wall 2B are joined together by adhesion, fusion adhesion or the like to form the reinforcement wall 2.

Also in the heel counter 1 used in the example illustrated in FIGS. 6 to 8, it is of course possible that the inner half counter 1A is made of a soft material as compared with the material of the outer half counter 1B for improving the wearing feeling. Additionally, it is also possible that, in almost the same manner as carried out in the embodying example of FIG. 4, the inner heel reinforcement wall 2A of the inner half counter 1A and the outer heel reinforcement wall 2B of the outer half counter 1B may be constructed substantially equal in height, at the medial portion *a* of the heel counter 1. The inner heel reinforcement wall 2A of the inner half counter 1A may be constructed larger in height than the outer heel reinforcement wall 2B of the outer half counter 1B at the rear side portion *b* and the lateral portion *c* of the heel counter 1, as shown in FIG. 8.

In the foregoing case where the heel reinforcement wall 2 of the heel counter 1 is a multi-layered type, one as in the embodying examples shown in FIGS. 4, 5 or 8, if the outer layer, that is, the main reinforcement wall 2*a* of FIGS. 4 and 5 or the outer heel reinforcement wall 2B in FIG. 8 is made of a synthetic resin material reinforced with inorganic fibers such as glass fibers, carbon fibers or the like, the heel counter can be made comparatively light in weight and excellent in thoughness. A sports shoe can be prepared by attaching the heel counter 1 of this type to the heel portion 6 of the upper 5 and thus an increase in weight can be avoided and the sports shoe can be provided with an excellent durability.

Further, as shown in FIG. 8, a subsidiary flange 14 may be provided which projects downwards to face the outer peripheral side edge surface 10 of the shoe sole 8 on an outer edge of the flange portion 4 of the heel counter 1. The subsidiary flange 14 may be adhered to the outer circumferential side edge surface 10 of the shoe sole 8 when the flange portion 4 of the heel counter 1 is adhered to the upper surface 9 of the outer peripheral edge portion of the shoe sole 8. With this arrangement, the adhesion between the heel counter 1 and the shoe sole 8 can be strengthened, and in addition any partial compression of the resilient foam material in the shoe sole 8 at a portion thereof adjacent to the outer circumferential side edge portion 10 of the shoe sole 8 can be prevented. Accordingly, the prevention of the rolling of the heel portion during running can be made more effective.

As illustrated in FIG. 8, at least one cut-out open portion 16 may be formed in an inner edge 15 of the attaching portion 3 of the heel counter 1. Because of the cut-out portion 16, the heel counter 1 can be easily bent narrower, so that an attaching operation of the heel counter 1 to the heel portion 6 of the upper 5 may be facilitated.

It is of course at one's discretion to provide either one or both of the subsidiary flange 14 or the cut-out portion 16. In addition, the heel counter 1 of any of the embodying examples in FIGS. 3 and 4 may also be provided with the subsidiary flange 14 and/or with the cut-off portion 16.

As for the way of securing the heel counter 1 to the heel portion 6 of the upper 5, the inwardly bent portion 7 of the upper 5, and the shoe sole 8, any desired adhesive agent, fusion adhesion, or sewing or the like may be considered. Additionally, the heel portion 6 may be reinforced by putting a semicircular reinforcement member, a heel subsidiary leather or the like on the upper 5 in almost same manner as in the conventional shoe.

Thus, according to the present invention, the heel reinforcement wall 2 of the heel counter 1 is adhered to the heel portion 6 of the upper 5, so that the heel portion 6 can be extremely reinforced. In addition, the flange portion 4 provided on the heel counter 1 is adhered to the upper surface 9 of the outer peripheral edge portion of the shoe sole 8, so that the load of the runner's weight during running can be distributed over the whole of the flange portion 4 through the heel reinforcement wall 2 and thus it can prevent the heel portion from rolling. Additionally, the present invention can eliminate an unfavorable feature of a shoe sole of resilient foam material which is partly compressed excessively at the portion extending along the boundary line between the attaching portion and the heel reinforcement wall as in the conventional shoe. As a result, the present invention can prevent the attaching portion and the heel reinforcement wall from peeling one from another along the boundary line as in the conventional shoe.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A heel counter for a sports shoe comprising:

a heel reinforcement wall shaped to include an inner surface in conformity with an outer surface of a heel portion of an upper of a sports shoe; and an attaching portion formed to project inwards from a lower end portion of the heel reinforcement wall and a flange portion formed to project outwards from the lower end portion of the heel reinforcement wall are provided so that the inner surface of the heel reinforcement wall is adhered to the outer surface of the heel portion of the upper;

the attaching portion thereof is interposed between and adhered to an inwardly bent portion of the upper portion and a shoe sole, and the flange portion thereof is adhered to an upper surface of an outer peripheral edge portion of the shoe sole for preventing rolling of the heel portion;

said heel reinforcement wall of the heel counter comprises at least two layers including a main reinforcement wall made of a comparatively hard material and a subsidiary reinforcement wall made of a comparatively soft material and said main reinforcement wall and the subsidiary reinforcement wall are substantially equal in height one to another a medial portion of the heel counter, and the subsidiary reinforcement wall is larger in height than the main reinforcement wall at a rear side portion and a lateral portion of the heel counter.

2. A heel counter according to claim 1, wherein the flange portion of the heel counter is provided at its outer edge portion with a subsidiary flange.

3. A heel counter according to claim 1, wherein the attaching portion of the heel counter is provided at its inner edge portion with at least one cut-out portion.

4. A heel counter for a sports shoe comprising:

a heel reinforcement wall shaped to include an inner surface in conformity with an outer surface of a heel portion of an upper of a sports shoe; and an attaching portion formed to project inwards from a lower end portion of the heel reinforcement wall and a flange portion formed to project outward from the lower end portion of the heel reinforcement wall are provided so that the inner surface of the heel reinforcement wall is adhered to the outer surface of the heel portion of the upper;

the attaching portion thereof is interposed between and adhered to an inwardly bent portion of the upper portion and a shoe sole, and the flange portion thereof is adhered to an upper surface of an outer peripheral edge portion of the shoe sole for preventing rolling of the heel portion;

said heel counter comprises an inner half counter wherein the attaching portion is formed to project inwards from a lower end portion of an inner heel reinforcement wall and an outer half counter includes the flange portion formed to project outwards from a lower end portion of an outer heel reinforcement wall, and the heel reinforcement wall comprises the inner heel reinforcement wall of the inner half counter and the outer heel reinforcement wall of the outer half counter which are adhered together into plural layers, said outer half counter is made of a comparatively hard material, and the inner half counter is made of a comparatively soft material and said inner heel reinforcement wall are substantially equal in height at a medial portion of the heel counter, and the inner heel reinforcement wall is larger in height than the outer heel reinforcement wall at a rear side portion and a lateral portion of the heel counter.

5. A heel counter according to claim 4, wherein the flange portion of the heel counter is provided at its outer edge portion with a subsidiary flange.

6. A heel counter according to claim 4, wherein the attaching portion of the heel counter is provided at its inner edge portion with at least one cut-out portion.

* * * * *